US005252446A

United States Patent [19]

Hirabayashi et al.

[11] Patent Number: 5,252,446

[45] Date of Patent: Oct. 12, 1993

[54] SILVER HALIDE COLOR PHOTOGRAPHIC LIGHT-SENSITIVE MATERIAL COMPRISING A 1-PENTACHLORINATED PHENYL-5-PYRAZOLONE COUPLER AND SPECIFIC RED SENSITIZING DYES

[75] Inventors: Shigeto Hirabayashi, Hachioji; Shuichi Sugita, Kunitachi; Katsumasa Yamazaki, Hachioji, all of Japan

[73] Assignee: Konica Corporation, Tokyo, Japan

[21] Appl. No.: 942,465

[22] Filed: Sep. 9, 1992

[30] Foreign Application Priority Data

Sep. 25, 1991 [JP] Japan ..... 3-273425

[51] Int. Cl.[5] ..... G03C 1/08

[52] U.S. Cl. ..... 430/508; 430/555; 430/585; 430/588; 430/505

[58] Field of Search ..... 430/508, 505, 588, 585, 430/555

[56] References Cited

U.S. PATENT DOCUMENTS

| | | | |
|---|---|---|---|
| 2,311,081 | 6/1941 | Porter et al. | 430/386 |
| 2,369,489 | 2/1945 | Porter et al. | 430/386 |
| 2,439,098 | 4/1948 | Porter et al. | 548/366.4 |
| 2,600,788 | 6/1952 | Loria et al. | 430/386 |
| 2,938,892 | 5/1960 | Sheehan | 350/354 |
| 2,950,197 | 8/1960 | Allen et al. | 430/625 |
| 2,964,404 | 12/1960 | Burness | 430/625 |
| 2,983,611 | 5/1961 | Allen et al. | 430/623 |
| 3,047,394 | 7/1962 | Allen et al. | 430/624 |
| 3,226,234 | 12/1965 | Himmelmann et al. | 430/621 |
| 3,271,175 | 10/1966 | Burness et al. | 106/125 |
| 3,325,287 | 6/1967 | Yamamoto et al. . | |
| 3,396,029 | 8/1968 | Himmelmann et al. | 430/621 |
| 3,490,911 | 1/1970 | Burness et al. | 430/543 |
| 3,514,450 | 5/1970 | Rauch et al. | 530/588 |
| 3,539,644 | 11/1970 | Burness et al. | 568/32 |
| 3,558,319 | 1/1971 | Hamaoka et al. | 430/554 |
| 3,623,878 | 11/1971 | Nishio et al. | 430/624 |
| 3,640,720 | 2/1972 | Cohen | 430/622 |
| 3,677,764 | 7/1972 | Glockner et al. | 430/449 |
| 3,832,181 | 8/1974 | Dallon et al. | 430/539 |
| 3,840,370 | 10/1974 | Dallon et al. | 430/537 |
| 4,043,818 | 8/1977 | Himmelmann et al. | 430/621 |
| 4,061,499 | 12/1977 | Himmelmann | 430/422 |
| 4,199,361 | 4/1980 | Furutachi | 430/508 |
| 4,326,023 | 4/1982 | DeSeyn | 430/588 |
| 4,622,290 | 11/1986 | Tanaka et al. | 430/574 |
| 4,830,958 | 5/1989 | Okumura et al. | 430/585 |

FOREIGN PATENT DOCUMENTS

| | | |
|---|---|---|
| 2336711 | 7/1980 | France . |
| 1552701 | 9/1979 | United Kingdom . |

*Primary Examiner*—Charles L. Bowers, Jr.
*Assistant Examiner*—Geraldine Letscher
*Attorney, Agent, or Firm*—Finnegan, Henderson, Farabow, Garrett & Dunner

[57] ABSTRACT

There is provided a silver halide color photographic light-sensitive material whose green-sensitive and red-sensitive layers are improved in sensitivity and which involves little variation among printers. The photographic material comprising a blue-sensitive layer, a green-sensitive layer and a red-sensitive layer, wherein the green-sensitive layer contains a magenta coupler M-I and the red-sensitive layer contains a sensitizing dye S-I represented by the following formulas:

M-I

S-I

6 Claims, No Drawings

SILVER HALIDE COLOR PHOTOGRAPHIC LIGHT-SENSITIVE MATERIAL COMPRISING A 1-PENTACHLORINATED PHENYL-5-PYRAZOLONE COUPLER AND SPECIFIC RED SENSITIZING DYES

FIELD OF THE INVENTION

The present invention relates to a silver halide color photographic light-sensitive material, more specifically a silver halide color photographic light-sensitive material whose green-sensitive and red-sensitive layers are both highly sensitive and which involves little variation among printers.

BACKGROUND OF THE INVENTION

Presently, the three subtractive primaries are used to process silver halide color photographic light-sensitive materials, wherein color images are formed with a combination of the three dyes formed upon coupling reaction of a yellow coupler, a magenta coupler, a cyan coupler and a p-phenylenediamine-based color developing agent.

Magenta couplers used in conventional silver halide color photographic light-sensitive materials are pyrazolone couplers, pyrazolinobenzimidazole couplers, pyrazolonetriazole couplers and indanone couplers, of which various 5-pyrazolone derivatives are widely used.

Examples of groups used as the 3-position substituent for the 5-pyrazolone ring of the above 5-pyrazolone derivatives include alkyl groups, aryl groups, the alkoxy group described in U.S. Pat. No. 2,439,098, the acylamino groups described in U.S. Pat. Nos. 2,369,489 and 2,600,788 and the ureide group described in U.S. Pat. No. 3,558,319. However, these couplers have some drawbacks; for example, the coupling activity with the oxidation product of developing agent is low, high densities of magenta dye images cannot be obtained, the magenta dye image obtained by color developing has great secondary absorption in the blue light band, and the sharpness of the primary absorption on the long wavelength side is poor.

Also, the 3-anilino-5-pyrazolone couplers described in U.S. Pat. Nos. 2,311,081 and 3,677,764, British Patent Nos. 956,261 and 1,173,513 and other publications offer advantages such as high coupling activity for good coloring performance and little undesirable absorption in the red light band. However, these conventional 3-anilino-5-pyrazolone couplers pose a problem of deterioration of color reproducibility etc. when they are used in color negative silver halide photographic light-sensitive materials because their primary absorption is in relatively short wavelengths.

It has recently been found that in using a color negative film for printing on color printing paper, there is variation in the hue of the finished color print among the printing machines used (hereinafter referred to as printers), which variance is hereinafter referred to as variation among printers, and that this is partially attributable to the tone of the dye resulting from the magenta coupler used in the color negative film.

It has also been found that this variation among printers widens significantly when the above-mentioned 3-anilino-5-pyrazolone couplers are used.

Although significant improvement in variation among printers is achieved by the use of the magenta coupler described in Japanese Patent Examined Publication No. 30615/1980, the level reached remains unsatisfactory.

Also, with the recent trend toward format size reduction in photographic light-sensitive materials and the popularization of panorama prints (panoramic exposure is given to the central portion of a 35 mm film, the exposed portion printed wide latitudinally), there has been demand for a photographic light-sensitive material offering high sharpness and high image quality. The image quality offered by a silver halide photographic light-sensitive material depends on various factors, including silver halide grain size. It is known that size reduction in the silver halide grains used is very effective in improving image quality; there is demand for a technology offering high sensitivity with small-sized silver halide grains.

It is obvious to those skilled in the art that certain polymethine dyes are very effective in spectrally sensitizing silver halide emulsions, including the various types of compounds described by T. H. James on pages 194–234 of "The Theory of the Photographic Process", 4th edition (1977, MacMillan, New York). These sensitizing dyes are required not only to broaden the sensitivity wavelength range of the silver halide emulsion but also to meet the following requirements.

1) To offer appropriate spectral sensitization by the sensitizing dye.

2) To have high sensitizing efficiency and offer sufficient sensitivity.

3) To be free of fogging.

4) To exhibit no adverse interaction with other additives such as stabilizers, antifogging agents, couplers, oxidized developer scavengers and coating aids.

5) To undergo neither dye desorption nor sensitivity reduction when the silver halide coating emulsion containing the sensitizing dye is kept standing for a long time.

6) To cause neither increase in fog density nor sensitivity reduction when the silver halide light-sensitive material containing the sensitizing dye is left under high-temperature high-moisture conditions for a long time.

7) To cause no color cross-over (color mixing) after development as a result of diffusion of the added sensitizing dye into another light-sensitive layer.

To meet these requirements, which are significant in preparing a silver halide emulsion, various compounds have been proposed and synthesized. Particularly azole ring trimethinecyanine dyes having a chalcogen atom in the ring thereof, such as thiacarbocyanine, oxathiacarbocyanine, selenacarbocyanine and oxaselenacarbocyanine, are known as principal red sensitizers having a preferable spectrum sensitivity in the red light band and offering excellent spectral sensitizing efficiency. Examples of such dyes include the cyanine dye described in U.S. Pat. No. 3,615,644, wherein an alkoxy group is present as a substituent on the condensed ring, the thiocarbocyanine dye described in U.S. Pat. No. 2,429,574, which has a methylenedioxy substituent, the thiacarbocyanine dye described in U.S. Pat. No. 2,515,913, wherein a phenyl group is present as a substituent at the 5 position, the thiacarbocyanine dye described in U.S. Pat. No. 2,647,050, wherein a carboxyl group is present as a substituent at the 5 position, the thiocarbocyanine dyes described in U.S. Pat. Nos. 2,647,051 and 2,647,052, wherein an alkoxycarbonyl group is present as a substituent at the 5 position, the carbocyanine dye described in U.S. Pat. No. 2,485,679, wherein a phenyl group is present as a substituent at the 6 position, the saturated carbon ring condensed thiazolocarbocyanine dye described in U.S. Pat. No. 2,336,843, the various other carbocyanine dyes described in U.S. Pat. Nos. 1,846,302, 2,112,140 and 2,481,464 and other publications, the trimethine dyes described in U.S. Pat. Nos. 2,369,646, 2,385,815, 2,484,536, 2,415,927, 2,478,366, 2,739,964, 3,282,932 and 3,384,489 and other publications, wherein a substituent is present on a carbon atom in the methine, the trimethinecyanine dyes described in U.S. Pat. Nos. 2,647,053, 2,521,705 and 2,072,908, British Patent No. 654,690, Japanese Patent Examined Publication No. 21711/1961 and other publications, wherein an anion group is present as a substituent, and the oxathiacarbocyanine dye described in British Patent No. 1,012,825. Some of these carbocyanine dyes, when used singly or in combination, meet the requirements described above. However, staining resulting from the residence of the spectral sensitizing dye in the light-sensitive material after developing (hereinafter referred to as residual staining) was found a cause of the above-described variation among printers. In this regard, conventional carbocyanine dyes proved unsatisfactory.

SUMMARY OF THE INVENTION

The object of the present invention is to provide a silver halide color photographic light-sensitive material whose green-sensitive and red-sensitive layers are both highly sensitive and which involves little variation among printers.

The object of the present invention is accomplished by a silver halide color photographic light-sensitive material having on the support photographic component layers including a blue-sensitive silver halide emulsion layer, a green-sensitive silver halide emulsion layer and a red-sensitive silver halide emulsion layer, wherein at least one green-sensitive silver halide emulsion layer contains at least one kind of the magenta coupler represented by the following formula M-I and at least one red-sensitive silver halide emulsion layer contains at least one kind of the spectral sensitizing dye represented by the following formula S-I.

Formula M-I

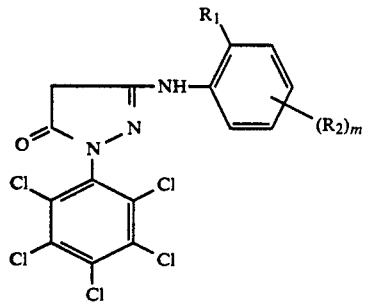

wherein $R_1$ represents a halogen atom or an alkoxy group; $R_2$ represents an acylamino group, a sulfonamide group, an imide group, a carbamoyl group, a sulfamoyl group, an alkoxycarbonyl group, an alkoxycarbonylamino group or an alkoxy group; m represents an integer of 0 to 4.

Formula S-I

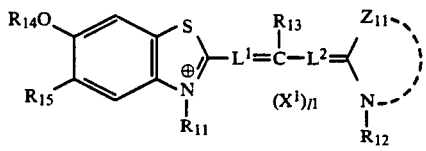

wherein $R_{11}$ and $R_{12}$ independently represent an alkyl group having 1 to 10 carbon atoms or an alkenyl group having 3 to 10 carbon atoms; $R_{13}$ represents a hydrogen atom, a heterocyclic group, an aryl group or an alkyl group; $R_{14}$ and $R_{15}$ independently represent an alkyl group; $Z_{11}$ represents a group of non-metallic atoms necessary to form a 5-membered nitrogen-containing heterocyclic ring which may optionally have a condensed ring as bonded thereto; $L^1$ and $L^2$ independently represent a methine group; $R_{11}$ and $L^1$ or $R_{12}$ and $L^2$ may bind together to form a 5- or 6-membered heterocyclic ring; $X^1$ represents an ion which neutralizes the charge in the molecule; $l^1$ represents the number of ions necessary to neutralize the charge in the molecule; provided that the compound forms an intramolecular salt, $l^1$ represents 0.

DETAILED DESCRIPTION OF THE INVENTION

The present invention is hereinafter described in detail.

With respect to formula M-I, the halogen atom represented by $R_1$ is exemplified by a chlorine atom, a bromine atom and a fluorine atom; the alkoxy group represented by $R_1$ is exemplified by a methoxy group and a dodecyloxy group. $R_1$ is preferably a chlorine atom.

The acylamino group represented by $R_2$ is exemplified by a 2,4-di-t-pentylphenoxyacetamide group and a 4-(2,4-d-t-pentylphenoxy)butanamide group. The sulfonamide group represented by $R_2$ is exemplified by a 4-dodecyloxyphenylsulfonamide group. The imide group represented by $R_2$ is exemplified by an octadecenylsuccinimide group. The carbamoyl group represented by $R_2$ is exemplified by a 4-(2,4-di-t-pentylphenoxy)butylaminocarbonyl group. The sulfamoyl group represented by $R_2$ is exemplified by a tetradecanesulfamoyl group. The alkoxycarbonyl group represented by $R_2$ is exemplified by a tetradecaneoxycarbonyl group The alkoxycarbonylamino group represented by $R_2$ is exemplified by a dodecyloxycarbonylamino group. The alkoxy group represented by $R_2$ is exemplified by a methoxy group, an ethoxy group and an octyloxy group. $R_2$ is preferably an acylamino group which is present as a substituent at the p-position with respect to $R_1$. m is preferably 1.

Examples of the compound represented by formula M-I relating to the present invention (hereinafter referred to as magenta coupler M-I) are given below, which are not to be construed as limitative.

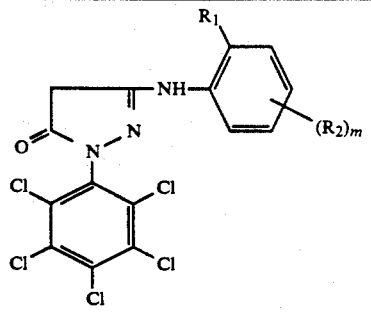

Compounds

| | $R_1$ | $(R_2)_m$ |
|---|---|---|
| M-1 | Cl | 5-NHCOCH$_2$O-(2-C$_5$H$_{11}$(t)-5-C$_5$H$_{11}$(t)) |
| M-2 | Cl | 5-NHCOCH(C$_2$H$_5$)O-(2-C$_5$H$_{11}$(t)-5-C$_5$H$_{11}$(t)) |
| M-3 | Cl | 5-NHCOCH((i)C$_3$H$_7$)O-(2-C$_5$H$_{11}$(t)-5-C$_5$H$_{11}$(t)) |
| M-4 | Cl | 5-NHCOCH(C$_4$H$_9$)O-(2-C$_5$H$_{11}$(t)-5-C$_5$H$_{11}$(t)) |
| M-5 | Cl | 5-NHCO(CH$_2$)$_3$O-(2-C$_5$H$_{11}$(t)-5-C$_5$H$_{11}$(t)) |
| M-6 | Cl | 5-NHSO$_2$C$_{16}$H$_{33}$ |
| M-7 | Cl | 5-NHSO$_2$-(1-OC$_{12}$H$_{25}$) |
| M-8 | OCH$_3$ | 5-NHSO$_2$C$_{12}$H$_{25}$ |
| | $R_A$ | $(R_B)_l$ |
| M-9 | Cl | 5-N(succinimide)-C$_{18}$H$_{35}$ |
| M-10 | Cl | 5-NHCOC$_{13}$H$_{27}$ |
| M-11 | OCH$_3$ | 5-NHCOCH(C$_{12}$H$_{25}$)-(2-OH-4-C$_4$H$_9$(t)) |
| M-12 | Cl | 5-NHCOCH(C$_2$H$_5$)-(1-C$_{15}$H$_{31}$) |
| M-13 | Cl | 5-CONHC$_{12}$H$_{25}$ |
| M-14 | Cl | 5-SO$_2$N(C$_8$H$_{17}$)$_2$ |
| M-15 | Cl | 4-OC$_8$H$_{17}$, 5-OC$_8$H$_{17}$ |
| M-16 | Cl | 5-COOC$_{12}$H$_{25}$ |

-continued

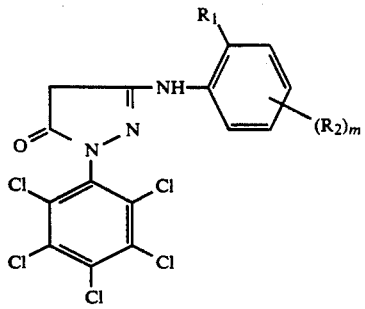

Compounds

| | | |
|---|---|---|
| M-17 | Cl | 5-NHCOCH(CH$_3$)CH$_2$SO$_2$C$_{12}$H$_{25}$ |
| M-18 | Cl | 5-NHCOCH(C$_{10}$H$_{21}$)-(1-SO$_2$-4-OH) |
| M-19 | Cl | 5-NHCOOC$_{12}$H$_{25}$ |
| M-20 | Cl | 5-OC$_{12}$H$_{25}$ |

These magenta couplers represented by formula M-I can be synthesized by the method described in Japanese Patent Publication Open to Public Inspection (hereinafter referred to as Japanese Patent O.P.I. Publication) No. 80027/1977.

An example of synthesis of magenta coupler M-I is given below.

Synthesis of Exemplified Compound M-5

To 75 ml of ethyl acetate was added 11.2 g of 1-pentachlorophenyl-3-(2-chloro-5-aminoanilino)- 5-pyrazolone. To this mixture was added 20 ml of water containing 2.7 g of sodium acetate dissolved therein, followed by stirring at room temperature for 1 hour. Next, 9.2 g of 4-(2,4-di-t-pentylphenoxy)butanoyl chloride dissolved in 25 ml of ethyl acetate was added over a period of 10 minutes. After stirring at room temperature for 3 hours, the water layer was removed, followed by washing with 50 ml of water, after which the ethyl acetate was distilled off under reduced pressure. The resulting residue was recrystallized from toluene to yield 12.8 g of the desired product as a white crystal, which had a melting point of 125° to 127° C.

This compound was identified as Exemplified Compound M-5 by mass spectrometry, NMR and IR spectrometry.

The magenta coupler M-I of the present invention can be used in the range of $1\times10^{-3}$ mol to 1 mol, preferably of $1\times10^{-2}$ mol to $8\times10^{-1}$ mol per mol of silver halide.

The magenta coupler M-I of the present invention can be used in combination with other magenta couplers. Examples of such magenta couplers include 5-pyrazolone couplers, pyrazoloazole couplers, pyrazolobenzimidazole couplers, open chain acylacetonitrile couplers and indazole couplers.

The spectral sensitizing dye represented by formula S-I of the present invention is described below.

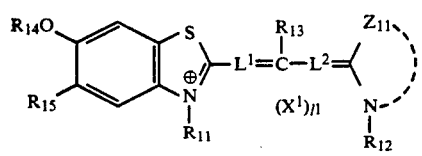

Formula S-I wherein $R_{11}$ and $R_{12}$ independently represent an alkyl group having 1 to 10 carbon atoms or an alkenyl group having 3 to 10 carbon atoms; $R_{13}$ represents a hydrogen atom, a heterocyclic group, an aryl group or an alkyl group; $R_{14}$ and $R_{15}$ independently represent an alkyl group; $Z_{11}$ represents a group of non-metallic atoms necessary to form a 5-membered nitrogen-containing heterocyclic ring which may have a condensed ring as bonded thereto; $L^1$ and $L^2$ independently represent a methine group; $R_{11}$ and $L^1$ or $R_{12}$ and $L^2$ may bind together to form a 5-or 6-membered heterocyclic ring; $X^1$ represents an ion which neutralizes the charge in the molecule; $1^1$ represents the number of ions necessary to neutralize the charge in the molecule; provided that the compound forms an intramolecular salt, $1^1$ represents 0.

With respect to the compound represented by formula S-I, $R_{11}$ and $R_{12}$ independently represent an alkyl group having 1 to 10 carbon atoms or an alkenyl group having 3 to 10 carbon atoms. Said alkyl group and alkenyl group may be linear or branched. Said alkyl group is exemplified by a methyl group, an ethyl group, a propyl group, a butyl group, a pentyl group, an isopentyl group, a 2-ethyl-hexyl group, an octyl group and a decyl group. Said alkenyl group is exemplified by a 2-propenyl group, a 3-butenyl group, 1-methyl-3-propenyl group, a 3-pentenyl group, a 1-methyl-3-butenyl group and a 4-hexenyl group. These groups may be substituted by a halogen atom such as a fluorine atom, a chlorine atom or a bromine atom, an alkoxy group such as a methoxy group or an ethoxy group, an aryloxy group such as a phenoxy group or a p-tolyloxy group, a cyano group, a carbamoyl group such as a carbamoyl group, an N-methylcarbamoyl group or an N,N-tetramethylenecarbamoyl group, a sulfamoyl group such as a sulfamoyl group or an N,N-3-oxapentamethyleneaminosulfonyl group, a methanesulfonyl group, an alkoxycarbonyl group such as an ethoxycarbonyl group or a butoxycarbonyl group, an aryl group such as a phenyl group or a carboxyphenyl group, an acyl group such as an acetyl group or a benzoyl group, an acylamino group such as an acetylamino group or a benzoylamino group, a sulfonamide group such as a methanesulfonamide group or a butanesulfonamide group or another substituent, and preferably have a water-soluble group such as a sulfo group, a carboxy group, a phosphono group, a sulfate group, a hydroxy group or a sulfino group.

Examples of alkyl groups having a water-soluble substituent include a carboxymethyl group, a sulfoethyl group, a sulfopropyl group, a sulfobutyl group, a sulfopentyl group, a 3-sulfobutyl group, a hydroxyethyl group, a carboxyethyl group, a 3-sulfinobutyl group, a 3-phosphonopropyl group, a p-sulfobenzyl group and an o-carboxybenzyl group. Examples of alkenyl groups having a water-soluble substituent include a 4-sulfobutenyl group and a 2-carboxy-2-propenyl group.

The alkyl group represented by $R_{13}$, $R_{14}$ or $R_{15}$ is exemplified by linear groups having 1 to 6 carbon atoms such as a methyl group, an ethyl group, a propyl group, a butyl group, a pentyl group and a hexyl group. The heterocyclic group represented by $R_{13}$ is exemplified by a 2-furyl group, a 2-thienyl group and a 1,3-bis(2-methoxyethyl)-6-hydroxy- 2,4-dioxo-1,2,3,4-tetrahydropyrimidin-5-yl group. The aryl group represented by $R_{13}$ is exemplified by a phenyl group and a naphthyl group. These alkyl groups, heterocyclic groups and aryl groups may have a substituent at any position. Examples of the substituent include halogen atoms such as a fluorine atom, a chlorine atom, a bromine atom and an iodine atom, trifluoromethyl groups, alkoxy groups such as a methoxy group, an ethoxy group, a butoxy group and other unsubstituted alkoxy groups and a 2-methoxyethoxy group, a benzyloxy group and other substituted alkoxy groups, hydroxy groups, cyano groups, aryloxy groups such as a phenoxy group, a tolyloxy group and other substituted or unsubstituted aryloxy groups, aryl groups such as a phenyl group, a p-chlorophenyl group, a p-carboxyphenyl group, an o-sulfophenyl group and other substituted or unsubstituted aryl groups, styryl groups, heterocyclic groups such as a thiazolyl group, a pyridyl group, a furyl group and a thienyl group, carbamoyl groups such as a carbamoyl group and an N-ethylcarbamoyl group, sulfamoyl groups such as a sulfamoyl group and an N,N-dimethylsulfamoyl group, acylamino groups such as an acetylamino group, a propionylamino group and a benzoylamino group, acyl groups such as an acetyl group and a benzoyl group, alkoxycarbonyl groups such as an ethoxycarbonyl group, sulfonamide groups such as a methanesulfonamide group and a benzenesulfonamide group, sulfonyl groups such as a methanesulfonyl group, a butanesulfonyl group and a p-toluenesulfonyl group, sulfo groups, carboxy groups, alkyl groups such as a methyl group, an ethyl group, an isopropyl group, a methoxyethyl group, a cyanomethyl group, a cyclohexyl group and other substituted or unsubstituted alkyl groups.

The 5-membered nitrogen-containing heterocyclic group formed by $Z_{11}$ is exemplified by oxazole rings such as an oxazoline ring, an oxazolidine ring, a benzoxazoline ring, a tetrahydrobenzoxazoline ring and a naphthoxazoline ring, thiazole rings such as a thiazoline ring, a thiazolidine ring, a 1,3,4-thiadiazoline ring, a benzothiazoline ring, a tetrahydrobenzothiazoline ring and a naphthothiazoline ring, selenazole rings such as a selenazoline ring, a selenazolidine ring, a tetrahydrobenzoselenazoline ring, a benzoselenazoline ring and a naphthoselenazoline ring, and imidazole rings such as an imidazoline ring, an imidazolidine ring, a benzimidazoline ring and a naphthoimidazoline ring. These rings may have a substituent at any position. Examples of the substituent include halogen atoms such as a fluorine atom, a chlorine atom, a bromine atom and an iodine atom, alkoxy groups such as a methoxy group, an ethoxy group, a butoxy group and other unsubstituted alkoxy groups and a 2-methoxyethoxy group, a benzyloxy group and other substituted alkoxy groups, hydroxy groups, cyano groups, aryloxy groups such as a phenoxy group, a tolyloxy group and other substituted or unsubstituted aryloxy groups, aryl groups such as a phenyl group, a p-chlorophenyl group and other substituted or unsubstituted aryl groups, styryl groups, heterocyclic groups such as a thiazolyl group, a pyridyl group, a furyl group and a thienyl group, carbamoyl groups such as a carbamoyl group and an N-ethylcarbamoyl group, sulfamoyl groups such as a sulfamoyl group and an N,N-dimethylsulfamoyl group, acylamino groups such as an acetylamino group, a propionylamino group and a benzoylamino group, acyl groups such as an acetyl group and a benzoyl group, alkoxycarbonyl groups such as an ethoxycarbonyl group, sulfonamide groups such as a methanesulfonamide group and a benzenesulfonamide group, sulfonyl groups such as a methanesulfonyl group, a butanesulfonyl group and a p-toluenesulfonyl group, carboxy groups, alkyl groups such as a methyl group, an ethyl group, an isopropyl group, a methoxyethyl group, a cyanomethyl group, a cyclohexyl group and other substituted or unsubstituted linear or cyclic alkyl groups.

The methine groups represented by $L^1$ and $L^2$ may be substituted or unsubstituted. Examples of the substituent include alkyl groups such as a methyl group, an ethyl group, an isobutyl group, a methoxyethyl group and other substituted or unsubstituted alkyl groups, aryl groups such as a phenyl group, a p-chlorophenyl group and other substituted or unsubstituted aryl groups, alkoxy groups such as a methoxy group and an ethoxy group and aryloxy groups such as a phenoxy group and a naphthoxy group.

The ion represented by $X^1$, which neutralizes the charge in the molecule, is selected out of anions and cations. The anions, whether organic or inorganic, include halogen ions such as a chlorine ion, a bromine ion and an iodine ion, organic acid anions such as a p-toluenesulfonate ion, a p-chlorobenzenesulfonate ion and a methanesulfonate ion, a tetrafluoroborate ion, a perchlorite ion, a methyl sulfate ion and an ethyl sulfate ion. The cations, whether organic or inorganic, include a hydrogen ion, alkali metal ions such as a lithium ion, a sodium ion, a potassium ion and a cesium ion, alkaline earth metal ions such as a magnesium ion and a calcium ion, an ammonium ion, organic ammonium ions such as a trimethylammonium ion, a triethylammonium ion, a tripropylammonium ion, a triethanolammonium ion and a pyridinium ion.

With respect to formula S-I, at least one of $R_{11}$ and $R_{12}$ has a water-soluble group such as a carboxy group, a phosphono group, a hydroxy group or a sulfo group as a substituent.

Examples of the sensitizing dye represented by formula S-I are given below, which are not to be construed as limitative.

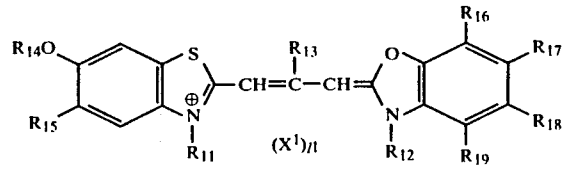

| No. | $(X^1)_{l1}$ | $R_{11}$ | $R_{12}$ | $R_{13}$ | $R_{14}$ | $R_{15}$ | $R_{16}$ | $R_{17}$ | $R_{18}$ | $R_{19}$ |
|---|---|---|---|---|---|---|---|---|---|---|
| 1 | — | $-CH_2COOH$ | $-(CH_2)_3SO_3^{\ominus}$ | $-C_2H_5$ | $-CH_3$ | $-CH_3$ | $-H$ | $-H$ | 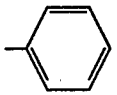 | $-H$ |
| 2 | $HN^{\oplus}(C_2H_5)_3$ | $-(CH_2)_2SO_3^{\ominus}$ | $-(CH_2)_4SO_3^{\ominus}$ | $-C_2H_5$ | $-CH_3$ | $-CH_3$ | $-H$ | $-H$ | $-Cl$ | $-H$ |
| 3 | $Li^{\oplus}$ | $-(CH_2)_4SO_3^{\ominus}$ | $-(CH_2)_2SO_3^{\ominus}$ | $-C_2H_5$ | $-CH_3$ | $-CH_3$ | $-H$ | $-H$ | 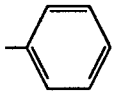 | $-H$ |
| 4 | $Li^{\oplus}$ | $-(CH_2)_2SO_3^{\ominus}$ | $-(CH_2)_4SO_3^{\ominus}$ | $-C_2H_5$ | $-CH_3$ | $-CH_3$ | $-H$ | $-H$ | $-OCH_3$ | $-H$ |
| 5 | $HN^{\oplus}(C_2H_5)_3$ | 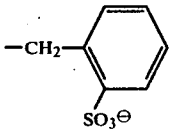 | $-(CH_2)_4SO_3^{\ominus}$ | $-C_2H_5$ | $-CH_3$ | $-CH_3$ | $-H$ | $-CH_3$ | $-Cl$ | $-H$ |
| 6 | $Li^{\oplus}$ | $-(CH_2)_4SO_3^{\ominus}$ | $-(CH_2)_3SO_3^{\ominus}$ | $-C_2H_5$ | $-CH_3$ | $-CH_3$ | $-H$ | $-H$ | $-Cl$ | $-H$ |
| 7 | — | $-(CH_2)_4SO_3^{\ominus}$ | $-(CH_2)_2OH$ | $-CH_3$ | $-CH_3$ | $-C_2H_5$ | $-H$ | $-CH_3$ | $-H$ | $-H$ |
| 8 | — | $-(CH_2)_2SO_3^{\ominus}$ | $-(CH_2)_4SO_3H$ | $-CH_3$ | $-CH_3$ | $-CH_3$ | $-H$ | $-H$ | $-Cl$ | $-H$ |
| 9 | — | $-CH_2COOH$ | $-(CH_2)_4SO_3^{\ominus}$ | $-C_3H_7(n)$ | $-CH_3$ | $-CH_3$ | $-H$ | $-H$ | $-CH_3$ | $-H$ |
| 10 | $HN^{\oplus}(C_2H_5)_3$ | $-(CH_2)_4SO_3^{\ominus}$ | $-(CH_2)_2SO_3^{\ominus}$ | 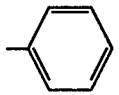 | $-CH_3$ | $-CH_3$ | $-H$ | $-H$ | $-Cl$ | $-H$ |
| 11 | $Li^{\oplus}$ | $-(CH_2)_3SO_3^{\ominus}$ | $-(CH_2)_4SO_3^{\ominus}$ | $-H$ | $-C_3H_7(n)$ | $-CH_3$ | $-H$ | $-H$ | $-Cl$ | $-H$ |
| 12 | $Na^{\oplus}$ | $-(CH_2)_4SO_3^{\ominus}$ | $-(CH_2)_2SO_3^{\ominus}$ | $-C_2H_5$ | $-CH_3$ | $-CH_3$ | $-H$ | 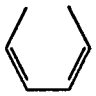 | | $-H$ |

-continued

| | | | | | | | | | | |
|---|---|---|---|---|---|---|---|---|---|---|
| 13 | — | $-(CH_2)_5SO_3^{\ominus}$ | $-(CH_2COOH$ | 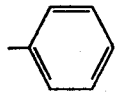 | $-C_2H_5$ | $-C_2H_5$ | —H | —H | —Cl | —H |
| 14 | $Na^{\oplus}$ | $-(CH_2)_4SO_3^{\ominus}$ | $-(CH_2)_2SO_3^{\ominus}$ | $-C_2H_5$ | $-C_2H_5$ | $-CH_3$ | —H | —Cl | —H | —H |
| 15 | — | $-CH_2COOH$ | $-(CH_2)_4SO_3^{\ominus}$ | $-C_2H_5$ | $-CH_3$ | $-CH_3$ | —H | —H | $-C_5H_{11}(t)$ | —H |
| 16 | $HN^{\oplus}(C_2H_5)_3$ | $-(CH_2)_2SO_3^{\ominus}$ | $-(CH_2)_3SO_3^{\ominus}$ | $-C_2H_5$ | $-CH_3$ | $-CH_3$ | —H | —H | 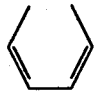 | |

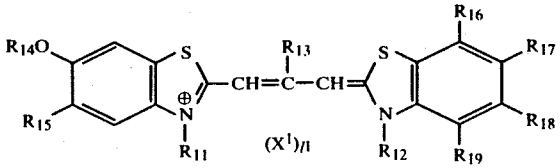

| No. | $R_{11}$ | $R_{12}$ | $R_{13}$ | $R_{14}$ | $R_{15}$ | $R_{16}$ | $R_{17}$ | $R_{18}$ | $R_{19}$ | $(X^1)_{/l}$ |
|---|---|---|---|---|---|---|---|---|---|---|
| 17 | $-(CH_2)_2SO_3^{\ominus}$ | $-(CH_2)_4SO_3^{\ominus}$ | $-C_2H_5$ | $-CH_3$ | $-CH_3$ | —H | —H | —Cl | —H | $Li^{\oplus}$ |
| 18 | $-(CH_2)_4SO_3^{\ominus}$ | $-(CH_2)_4SO_3^{\ominus}$ | $-C_2H_5$ | $-CH_3$ | $-CH_3$ | —H | —H | $-OCH_3$ | —H | $HN^{\oplus}(C_2H_5)_3$ |
| 19 | $-(CH_2)_5SO_3^{\ominus}$ | $-CH_2COOH$ | $-C_2H_5$ | $-CH_3$ | $-CH_3$ | —H | —H | $-CH_3$ | —H | — |
| 20 | 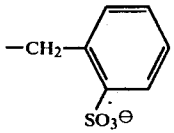 | 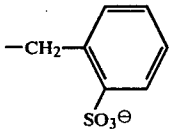 | $-C_2H_5$ | $-C_2H_5$ | $-CH_3$ | —H | —H | 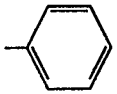 | —H | $HN^{\oplus}(C_2H_5)_3$ |
| 21 | $-(CH_2)_3SO_3^{\ominus}$ | $-(CH_2)_2SO_3^{\ominus}$ [58] | $-C_3H_7$ | $-CH_3$ | $-CH_3$ | —H | —H | —Cl | —H | $HN^{\oplus}(C_2H_5)_3$ |
| 22 | $-(CH_2)_3SO_3^{\oplus}$ | $-(CH_2)_3SO_3^{\ominus}$ | $-C_2H_5$ | $-CH_3$ | $-CH_3$ | —H | $-OCH_3$ | $-CH_3$ | —H | $Li^{\oplus}$ |
| 23 | $-(CH_2)_5SO_3^{\ominus}$ | $-(CH_2)_5SO_3^{\ominus}$ | $-CH_3$ | $-CH_3$ | $-CH_3$ | —H | $-OCH_3$ | $-CH_3$ | —H | $Na^{\oplus}$ |
| 24 | $-(CH_2)_4SO_3^{\ominus}$ | $-(CH_2)_4SO_3^{\ominus}$ | 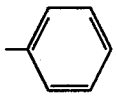 | $-CH_3$ | $-CH_3$ | —H | $-OCH_3$ | $-CH_3$ | —H | $HN^{\oplus}(C_2H_5)_2$ |
| 25 | $-CH_2COOH$ | $-(CH_2)_4SO_3^{\ominus}$ | $-C_2H_5$ | $-CH_3$ | $-CH_3$ | —H | $-OCH_3$ | $-CH_3$ | —H | — |
| 26 | $-(CH_2)_2SO_3^{\ominus}$ | $-(CH_2)_2SO_3^{\ominus}$ | $-C_2H_5$ | $-CH_3$ | $-CH_3$ | —H | $-OCH_3$ | $-CH_3$ | —H | $HN^{\oplus}(C_2H_5)_3$ |
| 27 | $-(CH_2)_2SO_3^{\ominus}$ | $-(CH_2)_2SO_3^{\ominus}$ | $-C_2H_5$ | $-C_2H_5$ | $-CH_3$ | —H | $-OC_2H_5$ | $-CH_3$ | —H | $K^{\oplus}$ |
| 28 | $-CH_2COOH$ | $-(CH_2)_2SO_3^{\ominus}$ | $-C_2H_5$ | $-CH_3$ | $-CH_3$ | —H | —H | —Cl | —H | — |

-continued

| | | | | | | | | | | |
|---|---|---|---|---|---|---|---|---|---|---|
| 29 | $-(CH_2)_2SO_3^{\ominus}$ | $-(CH_2)_3SO_3^{\ominus}$ | $-C_2H_5$ | $-CH_3$ | $-CH_3$ | $-H$ | $-H$ | 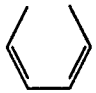 | | $K^{\oplus}$ |
| 30 | $-CH_2COOH$ | $-CH_2COO^{\ominus}$ | 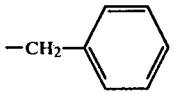 | $-C_3H_7$ | $-CH_3$ | $-H$ | $-OC_3H_7$ | $-CH_3$ | $-H$ | — |
| 31 | $-(CH_2)_4SO_3^{\ominus}$ | $-(CH_2)_4SO_3^{\ominus}$ | $-CH_3$ | $-CH_3$ | $-CH_3$ | $-H$ | $-CH_3$ | $-CH_3$ | $-H$ | $HN^{\oplus}(C_2H_5)_3$ |
| 32 | $-(CH_2)_2SO_3^{\ominus}$ | $-(CH_2)_2SO_3^{\ominus}$ | 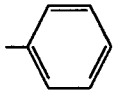 | $-CH_3$ | $-CH_3$ | $-H$ | $-CH_3$ | $-H$ | $-H$ | $Li^{\oplus}$ |
| 33<br>63 | $-(CH_2)_3SO_3$<br>$-(CH_2)_3SO_3^{\ominus}$ | $-H$ | $-CH_3$ | $-CH_3$ | $-H$ | $-OCH_3$ | $-CH_3$ | $-H$ | $HN^{\oplus}(C_2H_5)_3$ | |
| 34 | $-(CH_2)_3SO_3^{\ominus}$ | $-(CH_2)_3SO_3^{\ominus}$ | 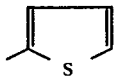 | $-CH_3$ | $-CH_3$ | $-H$ | $-OCH_3$ | $-CH_3$ | $-H$ | $Na^{\oplus}$ |
| 35 | $-C_2H_5$ | $-C_2H_5$ | 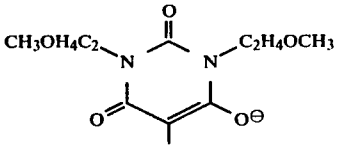 | $-CH_3$ | $-CH_3$ | $-H$ | $-OCH_3$ | $-CH_3$ | $-H$ | — |

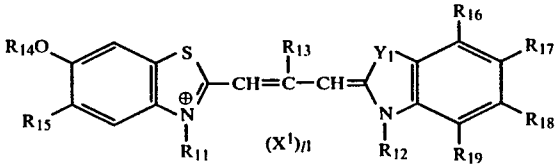

| No. | $R_{11}$ | $R_{12}$ | $R_{13}$ | $Y^1$ | $R_{14}$ | $R_{15}$ | $R_{16}$ | $R_{17}$ | $R_{18}$ | $R_{19}$ | $(X^1)_l$ |
|---|---|---|---|---|---|---|---|---|---|---|---|
| 36 | $-(CH_2)_2SO_3^{\ominus}$ | $-(CH_2)_2SO_3^{\ominus}$ | $-C_2H_5$ | Se | $-CH_3$ | $-CH_3$ | $-H$ | $-H$ | $-CH_3$ | $-H$ | $HN^{\oplus}(C_2H_5)_3$ |
| 37 | $-CH_2COOH$ | $-(CH_2)_4SO_3^{\ominus}$ | $-CH_3$ | Se | $-CH_3$ | $-CH_3$ | $-H$ | $-H$ | $-Cl$ | $-H$ | — |
| 38 | $-(CH_2)_4SO_3^{\ominus}$ | $-(CH_2)_4SO_3^{\ominus}$ | $-C_2H_5$ | Se | $-CH_3$ | $-CH_3$ | $-H$ | $-H$ | $-H$ | $-H$ | $Li^{\oplus}$ |
| 39 | $-CH_2COOH$ | $-(CH_2)_5SO_3^{\ominus}$ | $-H$ | Se | $-CH_3$ | $-CH_3$ | $-H$ | $-H$ | $-H$ | $-H$ | — |
| 40 | $-(CH_2)_3SO_3^{\ominus}$ | $-(CH_2)_3SO_3^{\ominus}$ | $-C_2H_5$ | Se | $-C_2H_5$ | $-CH_3$ | $-H$ | $-H$ | $-CH_3$ | $-H$ | $Li^{\oplus}$ |

-continued
| | | | | | | | | | | | |
|---|---|---|---|---|---|---|---|---|---|---|---|
| 41 | $-(CH_2)_3SO_3^{\ominus}$ | $-(CH_2)_3SO_3^{\ominus}$ | $-H$ | $>NC_2H_5$ | $-CH_3$ | $-CH_3$ | $-H$ | $-Cl$ | $-Cl$ | $-H$ | $K^{\oplus}$ |
| 42 | $-CH_2COOH$ | $-(CH_2)_2SO_3^{\ominus}$ | $-H$ | $>NC_2H_5$ | $-CH_3$ | $-CH_3$ | $-H$ | $-CN$ | $-Cl$ | $-H$ | — |
43
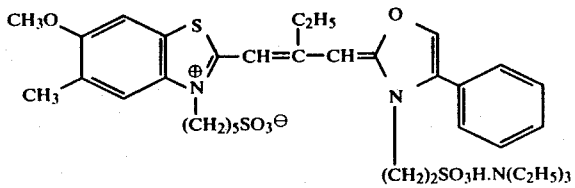
44
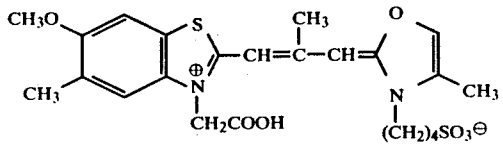
45
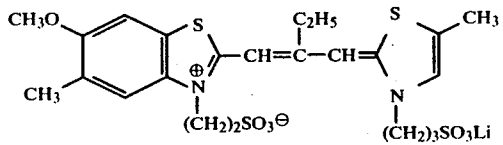

In the present invention, the use of the sensitizing dye represented by formula S-I in combination with the sensitizing dye represented by the following formula S-II or S-III is preferable because it offers the desired spectral band and higher red light sensitivity.

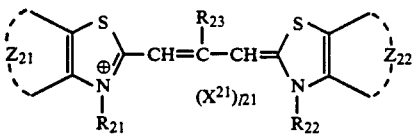

Formula S-II

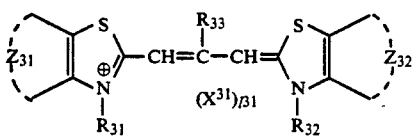

Formula S-III

With respect to formulas S-II and S-III, $R_{21}$, $R_{22}$, $R_{31}$ and $R_{32}$ independently represent an alkyl group having 1 to 10 carbon atoms or an alkenyl group having 3 to 10 carbon atoms, as with $R_{11}$ and $R_{12}$ in formula S-I. $R_{23}$ and $R_{33}$ independently represent an alkyl group, a heterocyclic group or an aryl group, as with $R_{13}$ in formula S-I.

$Z_{21}$ and $Z_{22}$ independently represent a group of non-metallic atoms necessary to form a benzene ring; $Z_{31}$ represents a group of non-metallic atoms necessary to form a benzene ring or a naphthalene ring; $Z_{32}$ represents a group of non-metallic atoms necessary to form a naphthalene ring, which may have a substituent specified for $Z_{11}$ in formula S-I at any position.

$X^{21}$ and $X^{31}$ independently represent an ion which neutralizes the charge in the molecule, as with $X^1$ in formula S-I; $l^{21}$ and $l^{31}$ independently represent the number required to neutralize the charge in the molecule; provided that the compound forms an intramolecular salt, $l^{21}$ and $l^{31}$ both represent 0.

The compound represented by formula S-II and the compound represented by formula S-III are selected out of the compounds of formula S-I described on pages 401–402 of Japanese Patent O.P.I. Publication No. 223748/1987 and those of formula S-II described on pages 401–402 of Japanese Patent O.P.I. Publication No. 223748/1987, respectively.

The compound of the present invention can easily be synthesized by the methods described in Berichte, 40, 4319 (1907), the Journal of Chemical Society, 127, 42–48 (1925), the Journal of the American Chemical Society, 39, 2198 (1917), the Journal of the American Chemical Society, 41, 1453 (1919) and U.S. Pat. No. 4,515,888, and conventional methods such as those described in "The Cyanine Dyes and Related Compounds", edited by F. M. Hamer (1964, Interscience Publishers).

The sensitizing dyes represented by formulas S-I, S-II and S-III, used for the present invention, can be added to silver halide emulsion by known methods. Examples of optionally usable methods include the methods described in Japanese Patent O.P.I. Publication No. 80826/1975 and 80827/1975, wherein the sensitizing dye is added in the form of a solution after protonization, the methods described in U.S. Pat. No. 3,822,135 and Japanese Patent O.P.I. Publication Nos. 11419/1975, 135437/1990 and 135438/1990, wherein the sensitizing dye is added after being dispersed with a surfactant, the methods described in U.S. Pat. Nos. 3,676,147, 3,469,987 and 4,247,627 and Japanese Patent O.P.I. Publication Nos. 59942/1976, 16624/1978 102732/1978, 102733/1978 and 137131/1978, wherein the sensitizing dye is added after being dispersed in a hydrophilic medium, the method described in East German Patent No. 143,324, wherein the sensitizing dye is added as a solid solution, and the methods described in Research Disclosure No. 21,802, U.S. Pat. No. 3,756,830, Japanese Patent Examined Publication No. 40659/1975 and Japanese Patent O.P.I. Publication No. 148053/1984, wherein the sensitizing dye is added after being dissolved in a water-soluble solvent for dissolving it, such as water, methanol, ethanol, propyl alcohol, acetone, fluorinated alcohol or low boiling solvents or dimethylformamide, methyl cellosolve, phenyl cellosolve or high boiling solvents or a mixture thereof.

Although the sensitizing dyes represented by formulas S-I, S-II and S-III may be added at any time during the emulsion preparing process between physical ripening and completion of chemical ripening and between completion of chemical ripening and coating, they are preferably added between physical ripening and completion of chemical ripening.

Addition of the sensitizing dye during physical ripening or before or immediately after adding the chemical sensitizer in the chemical ripening process is preferable because it offers higher spectral sensitivity.

Although the amount of the spectral sensitizing dye relating to the present invention used varies widely depending on the conditions and the type of emulsion used, it is preferably $1\times10^{-6}$ to $5\times10^{-3}$ mol, more preferably $2\times10^{-6}$ to $2\times10^{-3}$ mol per mol of silver halide.

The mixing ratio of two or more kinds of the sensitizing dye relating to the present invention can be optionally selected from the range offering the desired sensitivity. Also, the use of the sensitizing dye relating to the present invention in combination with a conventional supersensitizer offers a preferable effect. Examples of such supersensitizers include the compounds described on pages 323–326 of Japanese Patent O.P.I. Publication No. 174740/1987.

The silver halide for the silver halide emulsion used in the silver halide photographic light-sensitive material of the present invention may be optionally selected out of those used in ordinary silver halide emulsions based on silver bromide, silver iodobromide, silver iodochloride, silver chlorobromide and silver chloride.

The silver halide grains used in the silver halide emulsion may have a uniform silver halide composition distribution therein or a layer structure wherein the silver halide composition differs between the inside and the surface layer.

The silver halide grains may be grains wherein latent images are formed mainly on the surface thereof or grains wherein latent images are formed mainly therein.

The silver halide emulsion used may have any grain size distribution. An emulsion having a broad grain size distribution (referred to as a polydispersed emulsion) may be used. An emulsion having a narrow grain size distribution (referred to as a monodispersed emulsion) may be used singly or in combination of several kinds. A polydispersed emulsion and a monodispersed emulsion may be used in mixture.

The silver halide emulsion may be a mixture of two or more separately prepared silver halide emulsions.

The silver halide grains used for the present invention may be chemically sensitized by sulfur sensitization, selenium sensitization, reduction sensitization, noble metal sensitization and other sensitizing methods.

Of the silver halide grains used for the present invention, those other than the silver halide grains spectrally sensitized by a combination of some kinds of the sensitizing dye of the present invention may be spectrally sensitized in the desired wavelength band with a dye known as a sensitizing dye in the photographic industry.

The silver halide emulsion may incorporate an antifogging agent, a stabilizer and other additives.

Although it is advantageous to use gelatin as a binder or protective colloid for the emulsion and other elements of the silver halide photographic light-sensitive material of the present invention, gelatin derivatives, graft polymers of gelatin and other polymers, protein, sugar derivatives, cellulose derivatives, and hydrophilic colloids such as those of synthetic hydrophilic homopolymers or copolymers can also be used.

The photographic emulsion layers and other hydrophilic colloidal layers of the silver halide photographic light-sensitive material of the present invention are hardened by using singly or in combination hardeners which crosslink molecules of the binder or protective colloid and increase the film strength.

Examples of hardeners which can be used in the photographic light-sensitive material of the present invention include aldehyde hardeners, aziridine hardeners such as those described in PB Report No. 19,921, U.S. Pat. Nos. 2,950,197, 2,964,404, 2,983,611 and 3,271,175, Japanese Patent Examined Publication No. 40898/1971 and Japanese Patent O.P.I. Publication No. 91315/1975, epoxy hardeners such as those described in US Patent No. 3,047,394, West German Patent No. 1,085,663, British Patent No. 1,033,518 and Japanese Patent Examined Publication No. 35495/1973, vinyl sulfone hardeners such as those described in PB Report No. 19,920, West German Patent Nos. 1,100,942, 2,337,412, 2,545,722, 2,635,518, 2,742,308 and 2,749,260, British Patent No. 1,251,091, Japanese Patent Application Nos. 54236/1970 and 110996/1973 and U.S. Pat. Nos. 3,539,644 and 3,490,911, acryloyl hardeners such as those described in Japanese Patent Application No. 27949/1973 and U.S. Pat. No. 3,640,720, carboxy-active hardeners such as those described in WO-2357, U.S. Pat. Nos. 2,938,892, 3,331,609, 4,043,818 and 4,061,499, Japanese Patent Examined Publication Nos. 38715/1971, 38655/1980 and 32699/1983 and Japanese Patent O.P.I. Publication Nos. 155346/1980, 110762/1981, 225148/1985, 100743/1986 and 264044/1987, triazine hardeners such as those described in West German Patent Nos. 2,410,973 and 2,553,915, U.S. Pat. No. 3,325,287 and Japanese Patent O.P.I. Publication No. 12722/1977, polymeric hardeners such as those described in British Patent No. 822,061, U.S. Pat. Nos. 3,623,878, 3,396,029 and 3,226,234 and Japanese Patent Examined Publication Nos. 18578/1972, 18579/1972 and 48896/1972, maleimide hardeners, acetylene hardeners, methanesulfonate hardeners and N-methylol hardeners. These hardeners may be used singly or in combination. Examples of useful combinations of hardeners are given in West German Patent Nos. 2,447,587, 2,505,746 and 2,514,245, U.S. Pat. Nos. 4,047,957, 3,832,181 and 3,840,370, Japanese Patent O.P.I. Publication Nos. 43319/1973, 63062/1975 and 127329/1977 and Japanese Patent Examined Publication No. 32364/1973.

Of these compounds, the hydrophilic vinyl sulfone compounds described in U.S. Pat. No. 3,539,644 and Japanese Patent O.P.I. Publication Nos. 74832/1973, 24435/1974, 21059/1977, 77076/1977, 41221/1978, 57257/1978 and 241539/1988 are preferred, since their use offers better storage stability.

The silver halide emulsion may contain a plasticizer and a dispersion (latex) of a synthetic polymer which is insoluble or sparingly soluble in water.

The silver halide photographic light-sensitive material of the present invention may incorporate a coupler. The silver halide photographic light-sensitive material of the invention may also incorporate a competitive coupler having a color correcting effect and a compound which releases a photographically useful fragment such as a developing accelerator, a bleaching accelerator, a developing agent, a silver halide solvent, a toning agent, a hardener, a fogging agent, an antifogging agent, a chemical sensitizer, a spectral sensitizer or a desensitizer upon coupling with the oxidation product of a developing agent.

Known acylacetoanilide couplers can be preferably used as yellow dye forming couplers, of which benzoylacetoanilide series and pivaloylacetoanilide series compounds are advantageous. Phenol series or naphthol series couplers are commonly used as cyan dye forming couplers.

For adding a coupler to the light-sensitive material, known methods as used for ordinary couplers can be used. It is preferable to dissolve the coupler in a high boiling solvent used in combination with a low boiling solvent where necessary and add the resulting fine grain dispersion to the silver halide emulsion relating to the present invention. A hydroquinone derivative, an ultraviolet absorbent, an antifading agent and other additives may be used in combination as necessary.

The silver halide photographic light-sensitive material of the present invention may be provided with an auxiliary layer such as a filter layer, an anti-halation layer or an anti-irradiation layer. These layers and/or emulsion layers may contain a dye which oozes out or is bleached from the light-sensitive material during the developing process.

The silver halide photographic light-sensitive material of the present invention may incorporate a matting agent, a lubricant, an image stabilizer, an ultraviolet absorbent, a brightening agent, a surfactant, a developing accelerator, a developing inhibitor and a bleaching accelerator.

The photographic emulsion layers and other layers of the silver halide photographic light-sensitive material of the present invention may be formed on baryta paper, paper laminated with α-olefin polymer etc., a paper support permitting easy peeling of the α-olefin layer therefrom, a flexible reflective support such as synthetic paper, a film of a semisynthetic or synthetic polymer such as cellulose acetate, cellulose nitrate, polystyrene, polyvinyl chloride, polyethylene terephthalate, polycarbonate or polyamide, a reflective support coated with white pigment, a rigid substance such as glass, metal or porcelain, or a thin reflective support having a thickness of 120 to 160 μm.

When the silver halide photographic light-sensitive material of the present invention contains a coupler, exposure is followed by a commonly known color photographic process to obtain a dye image.

In the present invention, although color development may be immediately followed by processing with a processing solution capable of bleaching and a processing solution capable of fixing, it may be followed by processing with a processing solution capable of both bleaching and fixing (the so-called bleach-fixer). The bleaching agent used for this bleaching is a metal complex salt of organic acid.

Fixing is usually followed by washing. Washing may be replaced by stabilization, or may both be conducted in combination.

EXAMPLES

The present invention is hereinafter described in more detail by means of the following examples, which are not to be construed as limitative.

Example 1

Layers with the following compositions were sequentially formed on a triacetyl cellulose film support from the support side to yield a multiple-layered color photographic light-sensitive material sample No. 1.

The amount of addition in the multiple-layered color photograhpic light-sensitive material is expressed in grams per $m^2$, unless otherwise stated. The figures for silver halide and colloidal silver have been converted to the amount of silver. Figures for the amount of sensitizing dyes are shown in mol per mol of silver.

| | |
|---|---|
| Layer 1: Anti-halation layer (HC) | |
| Black colloidal silver | 0.15 |
| UV absorbent (UV-1) | 0.20 |
| Colored cyan coupler (CC-1) | 0.02 |
| High boiling solvent (Oil-1) | 0.20 |
| High boiling solvent (Oil-2) | 0.20 |
| Gelatin | 1.6 |
| Layer 2: Interlayer (IL-1) | |
| Gelatin | 1.3 |
| Layer 3: Low speed red-sensitive emulsion layer (RL) | |
| Silver iodobromide emulsion (Em-1) | 0.4 |
| Silver iodobromide emulsion (Em-2) | 0.3 |
| Sensitizing dye (S-A) | 3.2 × 10-4 |
| Sensitizing dye (S-2) | $3.2 \times 10^{-4}$ |
| Sensitizing dye (S-3) | $0.2 \times 10^{-4}$ |
| Cyan coupler (C-1) | 0.50 |
| Cyan coupler (C-2) | 0.13 |
| Colored cyan coupler (CC-1) | 0.07 |
| DIR compound (D-1) | 0.01 |
| High boiling solvent (Oil-1) | 0.55 |
| Gelatin | 1.0 |
| Layer 4: High speed red-sensitive emulsion layer (RH) | |
| Silver iodobromide emulsion (Em-3) | 0.9 |
| Sensitizing dye (S-A) | $1.7 \times 10^{-4}$ |
| Sensitizing dye (S-2) | $1.6 \times 10^{-4}$ |
| Sensitizing dye (S-3) | $0.1 \times 10^{-4}$ |
| Cyan coupler (C-2) | 0.23 |
| Colored cyan coupler (CC-1) | 0.03 |
| DIR compound (D-1) | 0.02 |
| High boiling solvent (Oil-1) | 0.25 |
| Gelatin | 1.0 |
| Layer 5: Interlayer (IL-2) | |
| Gelatin | 0.8 |
| Layer 6: Low speed green-sensitive emulsion layer (GL) | |
| Silver iodobromide emulsion (Em-1) | 0.6 |
| Silver iodobromide emulsion (Em-2) | 0.2 |
| Sensitizing dye (S-4) | $6.7 \times 10^{-4}$ |
| Sensitizing dye (S-5) | $0.8 \times 10^{-4}$ |
| Magenta coupler (M-A) | 0.47 |
| Colored magenta coupler (CM-1) | 0.10 |
| DIR compound (D-3) | 0.02 |
| High boiling solvent (Oil-2) | 0.70 |
| Gelatin | 1.0 |

-continued

| | |
|---|---|
| Layer 7: High speed green-sensitive emulsion layer (GH) | |
| Silver iodobromide emulsion (Em-3) | 0.9 |
| Sensitizing dye (S-6) | $1.1 \times 10^{-4}$ |
| Sensitizing dye (S-7) | $2.0 \times 10^{-4}$ |
| Sensitizing dye (S-8) | $0.3 \times 10^{-4}$ |
| Magenta coupler (M-A) | 0.20 |
| Colored magenta coupler (CM-1) | 0.04 |
| DIR compound (D-3) | 0.04 |
| High boiling solvent (Oil-2) | 0.35 |
| Gelatin | 1.0 |
| Layer 8: Yellow filter layer (YC) | |
| Yellow colloidal silver | 0.1 |
| Additive (SC-1) | 0.12 |
| High boiling solvent (Oil-2) | 0.15 |
| Gelatin | 1.0 |
| Layer 9: Low speed blue-sensitive emulsion layer (BL) | |
| Silver iodobromide emulsion (Em-1) | 0.25 |
| Silver iodobromide emulsion (Em-2) | 0.25 |
| Sensitizing dye (S-9) | $5.8 \times 10^{-4}$ |
| Yellow coupler (Y-1) | 0.60 |
| Yellow coupler (Y-2) | 0.32 |
| DIR compound (D-2) | 0.01 |
| High boiling solvent (Oil-2) | 0.18 |
| Gelatin | 1.3 |
| Layer 10: High speed blue-sensitive emulsion layer (BH) | |
| Silver iodobromide emulsion (Em-4) | 0.5 |
| Sensitizing dye (S-10) | $3.0 \times 10^{-4}$ |
| Sensitizing dye (S-11) | $1.2 \times 10^{-4}$ |
| Yellow coupler (Y-1) | 0.18 |
| Yellow coupler (Y-2) | 0.10 |
| High boiling solvent (Oil-2) | 0.05 |
| Gelatin | 1.0 |
| Layer 11: First protective layer (Pro-1) | |
| Silver iodobromide emulsion (Em-5) | 0.3 |
| UV absorbent (UV-1) | 0.07 |
| UV absorbent (UV-2) | 0.1 |
| High boiling solvent (Oil-1) | 0.07 |
| High boiling solvent (Oil-3) | 0.07 |
| Gelatin | 0.8 |
| Layer 12: Second protective layer (Pro-2) | |
| Alkali-soluble matting agent having an average grain size of 2 μm | 0.13 |
| Polymethyl methacrylate having an average grain size of 3 μm | 0.02 |
| Gelatin | 0.5 |

In addition to these compositions, a coating aid SU-2, a dispersing agent SU-1, a hardener H-1 and dyes AI-1 and AI-2 were added to appropriate layers.

The emulsions used to prepare the above sample were all monodispersed emulsions wherein the inner iodine content was high. They had the following properties.

Em-1: Emulsion comprising octahedral grains having an average silver iodide content of 7.5 mol % and an average grain size of 0.55 μm.

Em-2: Emulsion comprising octahedral grains having an average silver iodide content of 2.5 mol % and an average grain size of 7 0.36 μm.

Em-3: Emulsion comprising octahedral grains having an average silver iodide content of 8.0 mol % and an average grain size of 0.84 μm.

Em-4: Emulsion comprising octahedral grains having an average silver iodide content of 8.5 mol % and an average grain size of 1.02 μm.

Em-5: Emulsion comprising octahedral grains having an average silver iodide content of 2.0 mol % and an average grain size of 0.08 μm.

C-1
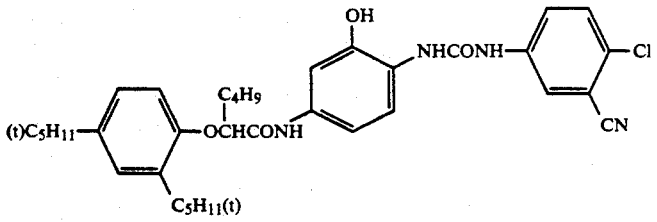
C-2
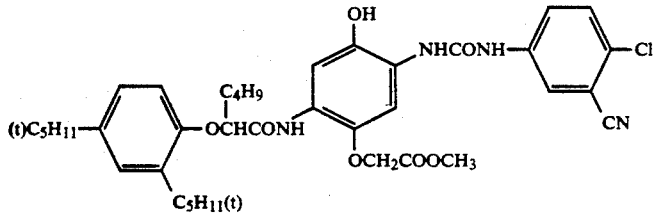
M-A
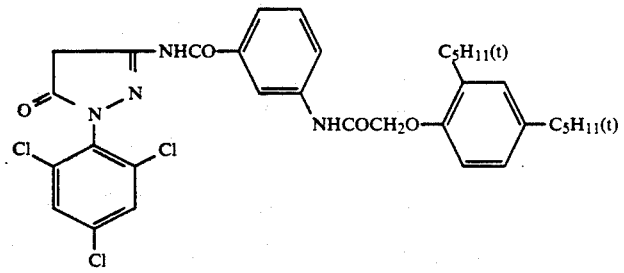
CM-1
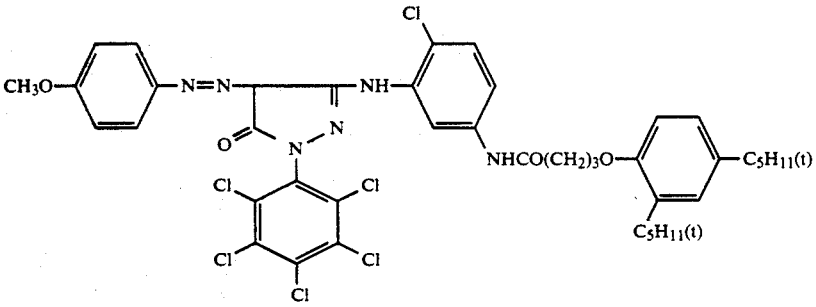
Y-1
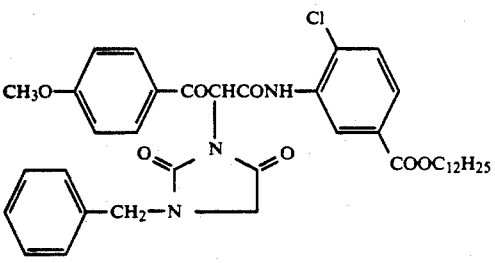
Y-2
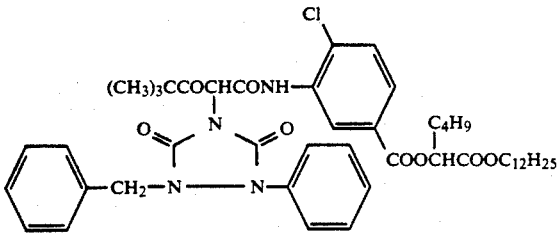

-continued
CC-1
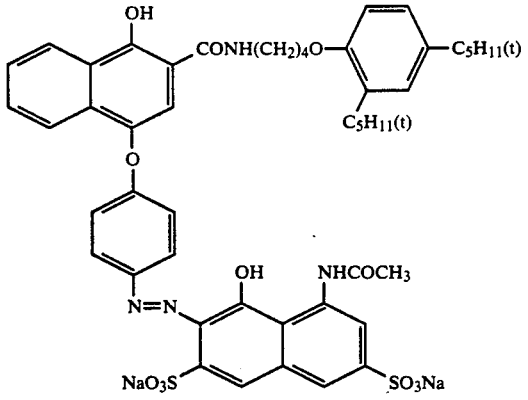
D-1
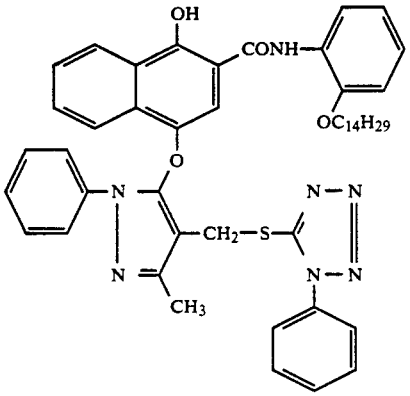
D-2
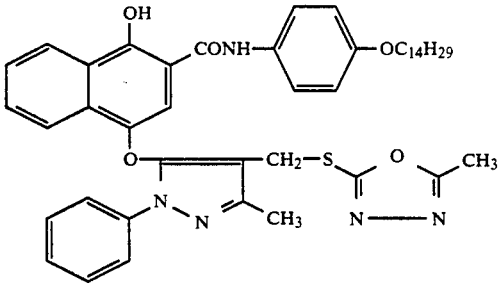
D-3
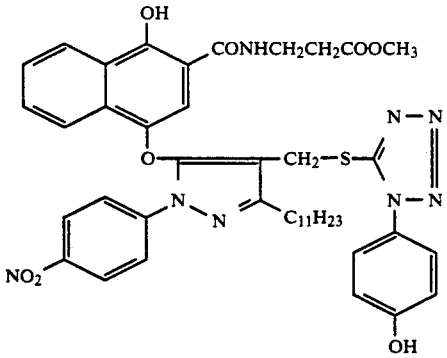
UV-1
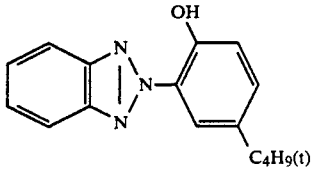

-continued
UV-2
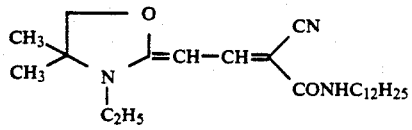
S-A
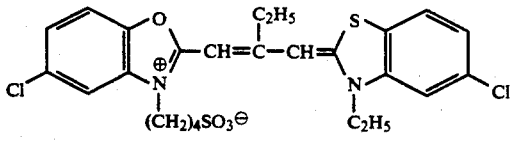
S-2
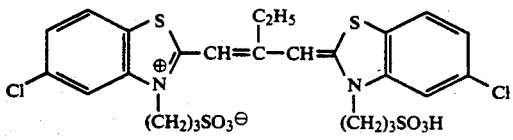
S-3
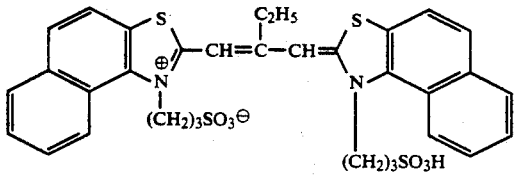
S-4
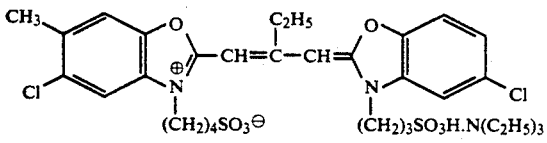
S-5
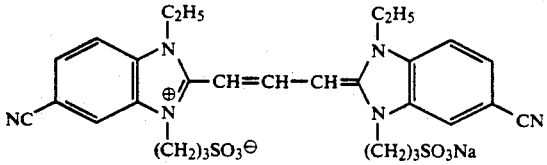
S-6
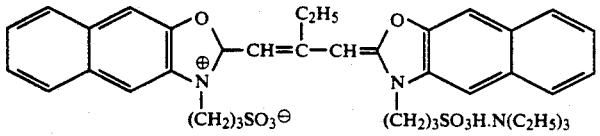
S-7
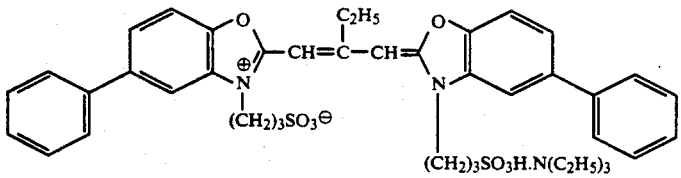
S-8
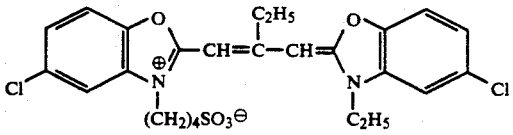
S-9
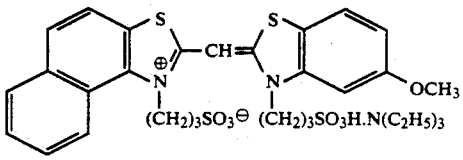

-continued
S-10
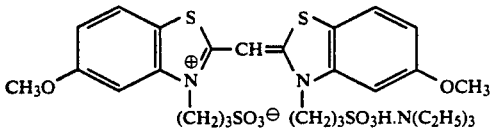
S-11
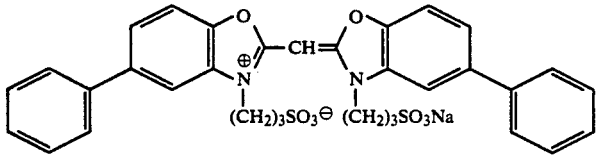
AI-1
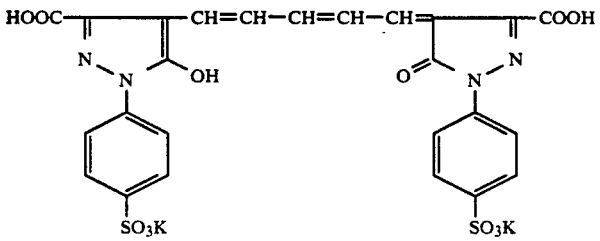
AI-2
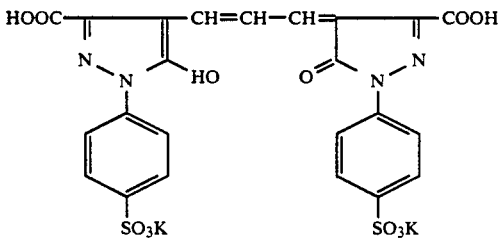
SU-1
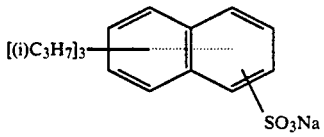
SU-2
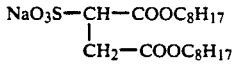
SC-1
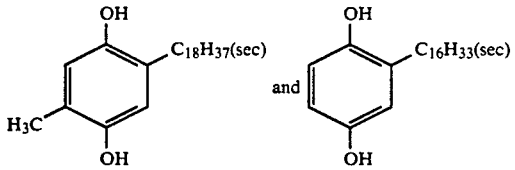
(mixture of 2:3)
H-1
Oil-1
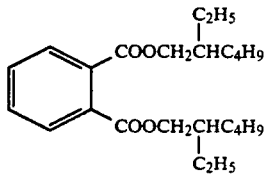
Oil-2
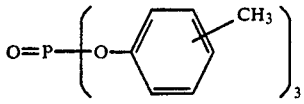

-continued

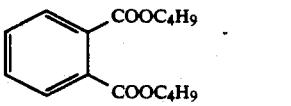

Oil-3

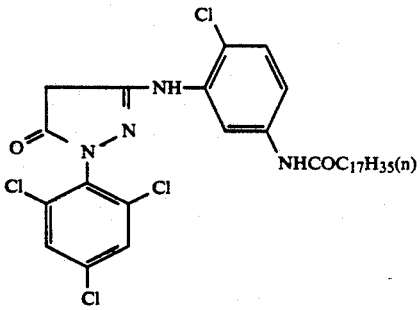

M-B

Sample Nos. 2 through 20 were prepared in the same manner as with sample No. 1 except that magenta coupler M-A for layers 6 and 7 and sensitizing dye S-A for layers 3 and 4 were changed as shown in Tables 1 and 2 (the amounts of addition were the same as with M-A and S-A, respectively).

Sample Nos. 1 through 20 thus prepared were each subjected to white light exposure through a sensitometric step wedge and processed using the following procedures, after which sensitometry was conducted for green light and red light to determine the sensitivities of the green-sensitive and red-sensitive layers. Sensitivity was obtained as the reciprocal of the amount of exposure required to give a density equivalent to fogging +0.3, and is expressed as percent ratio relative to the sensitivity of sample No. 1.

| Procedure (38° C.) | Processing time |
|---|---|
| Color development | 3 minutes 15 seconds |
| Bleaching | 6 minutes 30 seconds |
| Washing | 3 minutes 15 seconds |
| Fixation | 6 minutes 30 seconds |
| Washing | 3 minutes 15 seconds |
| Stabilization | 1 minute 30 seconds |

Drying

The processing solutions used in the respective processes had the following compositions.

| | |
|---|---|
| Color developer | |
| 4-amino-3-methyl-N-ethyl-N-(β-hydroxylethyl)aniline sulfate | 4.75 g |
| Anhydrous sodium sulfite | 4.25 g |
| Hydroxylamine.1/2 sulfate | 2.0 g |
| Anhydrous potassium carbonate | 37.5 g |
| Sodium bromide | 1.3 g |
| Trisodium nitrilotriacetate monohydrate | 2.5 g |
| Potassium hydroxide | 1.0 g |
| Water was added to make a total quantity of 1 l, and pH was adjusted to 10.05. | |
| Bleacher | |
| Ammonium iron (III) ethylenediaminetetraacetate | 100.0 g |
| Diammonium ethylenediaminetetraacetate | 10.0 g |

-continued

| | |
|---|---|
| Ammonium bromide | 150.0 g |
| Glacial acetic acid | 10.0 ml |
| Water was added to make a total quantity of 1 l, and aqueous ammonia was added to obtain a pH of 6.0. | |
| Fixer | |
| Ammonium thiosulfate | 175.0 g |
| Anhydrous sodium sulfite | 8.5 g |
| Sodium metasulfite | 2.3 g |
| Water was added to make a total quantity of 1 l, and acetic acid was added to obtain a pH of 6.0. | |
| Stabilizer | |
| Water | 900 ml |
| 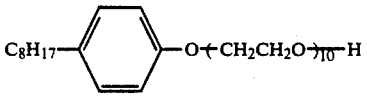 | 2.0 g |
| Dimethylolurea | 0.5 g |
| Hexamethylenetetramine | 0.2 g |
| 1,2-benzisothiazolin-3-one | 0.1 g |
| Siloxane (L-77, produced by UCC) | 0.1 g |
| Aqueous ammonia | 0.5 ml |
| Water was added to make a total quantity of 1 l, and aqueous ammonia or 50% sulfuric acid was added to obtain a pH of 8.5. | |

Using each of sample Nos. 1 through 20 thus prepared and a camera (Konica FT-1 MOTOR, produced by Konica Corporation), a color checker produced by Macbeth Company was photographed, followed by the same developing process as above.

The samples thus processed were subjected to printing, using printer A, to yield print sample Nos. IA through 19A, wherein the gray portion of the color checker was reproduced as a gray color with a reflection rate of 18%.

Next, using printer B, which has a green region detector different from that used in printer A, printing was performed under the same conditions as with printer A to yield print sample Nos. 1B through 19B, which were compared with print sample Nos. 1A through 19A to evaluate the visual variation between the printers. The results are given in Tables 1 and 2.

TABLE 1

| Sample No. | Magenta coupler Layer 6 | Magenta coupler Layer 7 | Sensitizing dye Layer 3 | Sensitizing dye Layer 4 | Sensitivity *1 O*3 | Sensitivity *1 P*4 | Variation between the printers*2 |
|---|---|---|---|---|---|---|---|
| 1 (comparative) | M-A | M-A | S-A | S-A | 100 | 100 | A |
| 2 (comparative) | M-B | M-B | S-A | S-A | 126 | 98 | C |

TABLE 1-continued

| Sample No. | Magenta coupler Layer 6 | Magenta coupler Layer 7 | Sensitizing dye Layer 3 | Sensitizing dye Layer 4 | Sensitivity *1 O*3 | Sensitivity *1 P*4 | Variation between the printers*2 |
|---|---|---|---|---|---|---|---|
| 3 (comparative) | M-5 | M-5 | S-A | S-A | 125 | 97 | B |
| 4 (inventive) | M-5 | M-5 | 6 | 6 | 126 | 122 | A |
| 5 (inventive) | M-1 | M-1 | 6 | 6 | 124 | 122 | A |
| 6 (inventive) | M-3 | M-3 | 6 | 6 | 125 | 123 | A |
| 7 (inventive) | M-7 | M-7 | 6 | 6 | 127 | 122 | A |
| 8 (inventive) | M-8 | M-8 | 6 | 6 | 125 | 124 | A |
| 9 (inventive) | M-5 | M-5 | 2 | 2 | 124 | 125 | A |
| 10 (inventive) | M-17 | M-17 | 2 | 6 | 127 | 125 | A |
| 11 (inventive) | M-5 | M-5 | 5 | 5 | 125 | 123 | A |
| 12 (inventive) | M-18 | M-5 | 5 | 6 | 126 | 124 | A |
| 13 (inventive) | M-5 | M-5 | 8 | 8 | 126 | 122 | A |

TABLE 2

| Sample No. | Magenta coupler Layer 6 | Magenta coupler Layer 7 | Sensitizing dye Layer 3 | Sensitizing dye Layer 4 | Sensitivity *1 O*3 | Sensitivity *1 P*4 | Variation between the printers*2 |
|---|---|---|---|---|---|---|---|
| 14 (inventive) | M-17 | M-17 | 8 | 6 | 124 | 124 | A |
| 15 (inventive) | M-5 | M-5 | 13 | 13 | 127 | 123 | A |
| 16 (inventive) | M-18 | M-5 | 13 | 6 | 126 | 123 | A |
| 17 (inventive) | M-5 | M-5 | 21 | 21 | 124 | 122 | A |
| 18 (inventive) | M-1 | M-1 | 21 | 6 | 123 | 124 | A |
| 19 (inventive) | M-5 | M-5 | 38 | 38 | 123 | 122 | A |
| 20 (inventive) | M-3 | M-7 | 38 | 38 | 126 | 123 | A |

*1Sensitivity is expressed as percent ratio relative to sample No. 1.
*2Variation between the printers was rated by sensory evaluation by 10 panelists in three grades: A, very small variation; B, small variation; C, wide variation.
*3O: Green-sensitive emulsion layer
*4P: Red-sensitive emulsion layer As is evident from Tables 1 and 2, sample No. 1, incorporating a non-inventive magenta coupler M-A and a non-inventive sensitizing dye S-A, was low in sensitivity in both the green-sensitive and red-sensitive layers. Sample No. 2, incorporating a non-inventive magenta coupler M-B, was low in sensitivity in the red-sensitive layer and very wide in variation between the printers, though the sensitivity in the green-sensitive layer was high. On the other hand, sample No. 3, incorporating an inventive magenta coupler in the green-sensitive layer, was low in sensitivity in the red-sensitive layer and thus cannot be said to be a good light-sensitive material, though the sensitivity in the green-sensitive layer was high and an improvement in variation between the printers was noted.

On the other hand, sample Nos. 4 through 20, all incorporating an inventive magenta coupler and an inventive sensitizing dye, were all highly sensitive in both the green-sensitive and red-sensitive layers and offered further improvement in the variation between the printers.

What is claimed is:

1. A silver halide color photographic light sensitive material comprising a support having thereon photographic component layers including a blue-sensitive silver halide emulsion layer, a green-sensitive silver halide emulsion layer and a red-sensitive silver halide emulsion layer, wherein said green-sensitive silver halide emulsion layer contains a magenta coupler represented by Formula [M-I] and said red-sensitive silver halide emulsion layer contains a compound represented by Formula [S-I];

Formula M-I

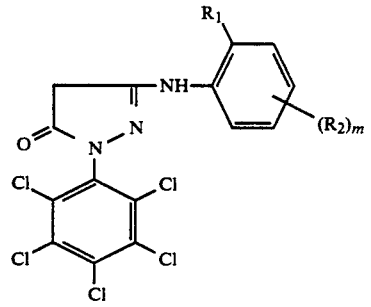

wherein $R_1$ represents a halogen atom or an alkoxy group; $R_2$ represents an acylamino group, a sulfonamido group, an imido group, a carbamoyl group, a sulfamoyl group, an alkoxycarbonyl group, an alkoxycarbonylamino group or an alkoxy group; and m represents an integer of 0 to 4;

Formula S-I

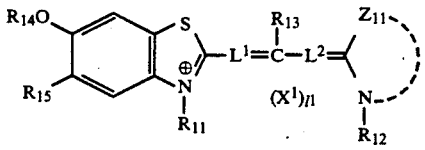

wherein $R_{11}$ and $R_{12}$ independently represent an alkyl group having 1 to 10 carbon atoms or an alkenyl group having 3 to 10 carbon atoms; $R_{13}$ represents a hydrogen atom, a heterocyclic group, an aryl group or an alkyl group; $R_{14}$ and $R_{15}$ independently represent an alkyl group; $Z_{11}$ represents a non-metallic atoms necessary to form a 5-membered nitrogen-containing heterocyclic ring, which may have a condensed ring as bonded thereto; $L^1$ and $L^2$ independently represent a methine group; $R_{11}$ and $L^1$ or $R_{12}$ and $L^2$ may bind together to form a 5- or 6-membered heterocyclic ring; $X^1$ represents an ion; $l^1$ represents the number of ions necessary to neutralize the charge in the molecule; provided that the compound forms an intramolecular salt, $l^1$ is 0.

2. A color photographic material of claim 1 wherein said magenta coupler is contained in an amount of $1\times10^{-3}$ to 1 mol per mol of silver halide.

3. A color photographic material of claim 2 wherein said magenta coupler is contained in an amount of $1\times10^{-2}$ to $8\times10^{-1}$ mol per mol of silver halide.

4. A color photographic material of claim 1 wherein in Formula [M-I], $R_1$ is a chlorine atom, $R_2$ is an acylamino group located at the para-position with respect to $R_1$, and m is 1.

5. A color photographic material of claim 1 wherein in Formula [S-I], at least one of $R_{11}$ and $R_{12}$ is a group having a carboxy group, a phosphono group, a hydroxy group or a sulfo group.

6. A color photographic material of claim 1 wherein said red-sensitive silver halide emulsion layer further contains a compound represented by Formula [S-II] or [S-III],

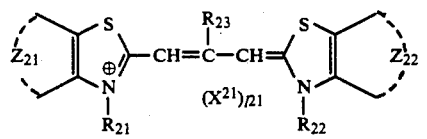

Formula [S-II]

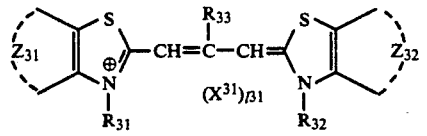

Formula [S-III]

wherein $R_{21}$, $R_{22}$, $R_{31}$ and $R_{32}$ independently represent an alkyl group having 1 to 10 carbon atoms or an alkenyl group having 3 to 10 carbon atoms; $R_{23}$ and $R_{33}$ independently represent an alkyl group, a heterocyclic group or an aryl group; $Z_{21}$ and $Z_{22}$ independently represent a group of non-metallic atoms necessary to form a benzene ring; $Z_{31}$ represent a group of non-metallic atoms necessary to form a benzene ring or a naphthalene ring; $Z_{32}$ represent a group of non-metallic atoms necessary to form a naphthalene ring; $X^{21}$ and $X^{31}$ independently represent a cation or anion; and $l^{21}$ and $l^{31}$ independently represent the number required to neutralize the charge in the molecule; provided that the compound forms an intramolecular salt, $l^{21}$ and $l^{31}$ both represent 0.

* * * * *